US007618506B2

(12) United States Patent
Yokoyama et al.

(10) Patent No.: US 7,618,506 B2
(45) Date of Patent: Nov. 17, 2009

(54) GAS GENERATING COMPOSITION

(75) Inventors: Takushi Yokoyama, Hyogo (JP); Mamoru Watabiki, Hyogo (JP); Jianzhou Wu, Hyogo (JP)

(73) Assignee: Daicel Chemical Industries, Ltd., Sakai-shi (JP)

( * ) Notice: Subject to any disclaimer, the term of this patent is extended or adjusted under 35 U.S.C. 154(b) by 88 days.

(21) Appl. No.: 10/695,759

(22) Filed: Oct. 30, 2003

(65) Prior Publication Data

US 2004/0154712 A1 Aug. 12, 2004

Related U.S. Application Data

(60) Provisional application No. 60/423,597, filed on Nov. 5, 2002.

(30) Foreign Application Priority Data

Oct. 31, 2002 (JP) ..... 2002-317337
Oct. 21, 2003 (JP) ..... 2003-360879
Oct. 24, 2003 (JP) ..... 2003-364024

(51) Int. Cl.
*C06B 45/10* (2006.01)
*C06B 31/00* (2006.01)

(52) U.S. Cl. ..... 149/19.1; 149/45

(58) Field of Classification Search ..... 149/19.2, 149/45, 92, 105, 19.1; 501/63, 68
See application file for complete search history.

(56) References Cited

U.S. PATENT DOCUMENTS

| | | | | |
|---|---|---|---|---|
| 2,946,694 | A * | 7/1960 | Labino | 501/44 |
| 4,021,275 | A * | 5/1977 | Kishi et al. | 149/35 |
| 4,369,079 | A | 1/1983 | Shaw | |
| 4,370,181 | A | 1/1983 | Lundstrom et al. | |
| 4,909,549 | A | 3/1990 | Poole et al. | |
| 5,013,782 | A * | 5/1991 | Tateno | 524/417 |
| 5,035,757 | A | 7/1991 | Poole | |
| 5,104,466 | A | 4/1992 | Allard et al. | |
| 5,386,775 | A * | 2/1995 | Poole et al. | 102/289 |
| 5,460,668 | A * | 10/1995 | Lyon | 149/36 |
| 5,542,999 | A | 8/1996 | Bucerius et al. | |
| 5,608,183 | A | 3/1997 | Barnes et al. | |
| 5,780,767 | A * | 7/1998 | Matsuda et al. | 149/2 |
| 6,123,790 | A * | 9/2000 | Lundstrom et al. | 149/47 |
| 6,143,102 | A | 11/2000 | Mendenhall et al. | |
| 6,241,281 | B1 * | 6/2001 | Hinshaw et al. | 280/741 |
| 6,517,647 | B1 * | 2/2003 | Yamato | 149/45 |
| 6,964,716 | B2 * | 11/2005 | Wu | 149/45 |
| 2004/0000362 | A1 * | 1/2004 | Sato et al. | 149/38 |

FOREIGN PATENT DOCUMENTS

| | | | |
|---|---|---|---|
| DE | 29821541 | U1 | 2/1999 |
| JP | 5-70109 | A | 3/1993 |
| JP | 10-502610 | A | 3/1998 |
| WO | WO 99/46009 | A | 9/1999 |
| WO | WO 01/34516 | A | 5/2001 |
| WO | WO 01/83274 | A | 11/2001 |

* cited by examiner

*Primary Examiner*—Aileen Felton
(74) *Attorney, Agent, or Firm*—Birch, Stewart, Kolasch & Birch, LLP

(57) ABSTRACT

A gas generating composition which can prevent formation of mist is provided. A gas generating composition comprising (a) a glass powder, (b) aluminum hydroxide and/or magnesium hydroxide, (c) an organic compound as fuel, and (d) an oxygen-containing oxidizing agent. By the action of the component (a), combustion residues can be solidified to form a slag, thus preventing formation of mist.

16 Claims, No Drawings

GAS GENERATING COMPOSITION

This Nonprovisional application claims priority under 35 U.S.C. § 119(e) on U.S. Provisional Application No(s). 60/423,597 filed on Nov. 5, 2002 and under 35 U.S.C. § 119(a) on Patent Application Nos. 2002-317337, 2003-360879, and 2003-364024 filed in Japan on Oct. 31, 2002; Oct. 21, 2003; and Oct. 24, 2003, the entire contents of which are hereby incorporated by reference.

BACKGROUND OF THE INVENTION

1 Field of the Invention

The present invention relates to a gas generating composition suitable for an air bag restraining system of automobiles and the like, a molded article thereof, and an inflator for an air bag using the same.

2 Description of the Related Art

As a gas generating agent for an air bag used in a passenger-protecting system in automobiles, a composition using sodium azide has been conventionally used. However, a toxicity to human bodies [$LD_{50}$(oral-rat)=27 mg/kg]or hazard in handling of sodium azide has been regarded as a serious problem. Therefore, as safe non-azide based gas generating compositions, gas generating compositions containing various nitrogen-containing organic compounds have been developed to replace the above composition.

U.S. Pat. No. 4,909,549 discloses a composition comprising hydrogen-containing tetrazole or triazole compounds and an oxygen-containing oxidizing agent. U.S. Pat. No. 4,370,181 discloses a gas generating composition comprising a hydrogen-free bitetrazole metal salt and an oxygen-free oxidizing agent. U.S. Pat. No. 4,369,079 discloses a gas generating composition comprising a hydrogen-free bitetrazole metal salt and an alkali metal nitrate, an alkali metal nitrite, an alkaline earth metal nitrate, an alkaline earth metal nitrite or a mixture thereof. U.S. Pat. No. 5,542,999 discloses a gas generating agent comprising a fuel such as GZT, TAGN (triaminoguanidine nitrate), NG (nitroguanidine), NTO and the like, a basic copper nitrate, a catalyst for reducing toxic gases and a coolant. U.S. Pat. No. 5,608,183 discloses a gas generating agent comprising a fuel such as guanidine nitrate, a basic copper nitrate and guar gum.

However, the above non-azide based gas generating composition forms residues (mist) after combustion, and thus a filter must be used to prevent the mist from flowing into an air bag. In this case, there is a method wherein the gas generating composition has a composition easily forming slag, after combustion, having a shape adapted to be readily captured by the filter.

U.S. Pat. No. 6,143,102 discloses that silica is added as a slag-forming agent to a composition comprising a fuel such as guanidine nitrate, a basic copper nitrate and a metal oxide such as alumina, to form excellent slag (clinker).

JP-A No. 10-502610 discloses that glass powder is added to a fuel such as a tetrazole compound and strontium nitrate, thereby lowering the combustion temperature, resulting in a reduction in NOx and CO and formation of solid slag.

U.S. Pat. No. 5,104,466 (JP-A 5-70109) discloses that an alkali metal azide, pellets consisting of an oxidizing agent and grains consisting of a silica-containing material are used as a mixture to reduce mist.

SUMMARY OF THE INVENTION

Accordingly, the present invention provides a novel gas generating composition forming slag more easily than the above compositions in the prior arts.

In one aspect of the present invention, a gas generating composition comprises (a) glass powder and (b) aluminum hydroxide and/or magnesium hydroxide.

In another aspect of the present invention, a gas generating composition comprises the following components (a) to (d):

(a) glass powder, (b) aluminum hydroxide and/or magnesium hydroxide, (c) an organic compound as fuel, and (d) an oxygen-containing oxidizing agent.

In yet another aspect of the present invention, a molded article is in the form of a single-perforated cylinder or a perforated (porous) cylinder obtained from the above gas generating composition. The single-perforation or perforation may be a through-hole or a hollow.

In another aspect of the present invention, an inflator for an air bag using the gas generating composition or the molded article.

The gas generating composition of the present invention and a molded article thereof contain glass powder, by which combustion residues can be solidified to form a slag, thus preventing the combustion residues from being converted into mist and released to the outside of an inflator. This effect can further be improved by using glass powder in combination with aluminum hydroxide and/or magnesium hydroxide.

DETAILED DESCRIPTION OF THE INVENTION

The glass powder used as component (a) in the present invention becomes molten upon combustion of the gas generating composition, and is immediately solidified as the temperature is decreased after combustion. In this process, the component (a) melts and solidifies combustion residues derived from other components, thereby trapping the residues to form a slag. Accordingly, the combustion residues are prevented from being converted into mist and released outside an inflator to flow in an air bag.

The glass powder is preferably an amorphous material consisting of a mixture of metal oxides and/or non-metal oxides, and the metal oxides are preferably those selected from silicon dioxide, sodium oxide, potassium oxide, calcium oxide, magnesium oxide, barium oxide, lead oxide, boron oxide, aluminum oxide and the like. The non-metal oxide is preferably selected from phosphorus oxide, tellurium oxide and bismuth oxide.

The glass powder is preferably one selected from the group consisting of quartz glass, 96% quartz glass, soda lime glass (windowpane, plate glass, bottle glass, glass for light bulb, etc.), lead glass (for electrical, optical and industrial art purposes), aluminoborosilicate glass, borosilicate glass (low expansion, low loss, tungsten sealing, etc.), aluminosilicate glass, phosphate glass, chalcogen glass, etc.

In particular, the softening point of such glass powder is varied depending on its composition, so that it is desirable that the glass powder having the softening point in the optimum range is selected corresponding to the combustion temperature of the composition consisting of an organic compound as fuel, an oxygen-containing oxidizing agent and other additives.

It is preferable in the invention, in particular, to use glass powder having a low softening point, more preferably a softening point of 1000° C. or lower, much more preferably a softening point of 590° C. or lower, still more preferably a softening point of 550° C. or lower, With glass powder having a low softening point, the slag-forming effect is increased and mist is difficult to produce.

The glass powder having a low softening point includes, for example, phosphate glass (including $P_2O_5$ and one selected from CaO, $B_2O_3$, $SiO_2$, $Al_2O_3$, $Fe_2O_3$, MgO, $Na_2O$, $K_2O$ and the like) or that represented by the following formula (I):

$$xMnO-ySiO_2-zAl_2O_3 \quad (I)$$

in which x, y and z are the mole number.

It is preferable that proportions of x, y and z of the formula (I) are 35 to 50 mole % of x, 30 to 60 mole % of y and 5 to 20 mole % of z, more preferably 40 to 45 mole % of x, 40 to 50 mole % of y and 10 to 15 mole % of z.

The particle diameter of the glass powder, in terms of 50% particle diameter, is preferably 10 to 300 μm, more preferably 10 to 100 μm, still more preferably 10 to 50 μm.

The content of the glass powder in the gas generating composition is preferably 0.1 to 20% by mass, more preferably 0.5 to 5% by mass. When the content of the glass powder is in the above range, the composition can preferably exhibit the slag-forming action without significantly lowering the efficiency of generation of gas.

Aluminum hydroxide and/or magnesium hydroxide used as component (b) of the present invention may be solely used or in combination of both. The component (b) is preferably magnesium hydroxide.

Aluminum hydroxide and/or magnesium hydroxide used as component (b) is low in toxicity, has a high decomposition starting temperature, and shows a significantly endothermic reaction upon thermal decomposition, to form aluminum oxide or magnesium oxide and water. It follows that, by incorporation of aluminum hydroxide and/or magnesium hydroxide, the combustion temperature of the gas generating composition is decreased, and after combustion, the formed amount of toxic nitrogen oxides and carbon monoxide is decreased. Together with the glass powder as component (a), aluminum oxide or magnesium oxide formed by decomposition of aluminum hydroxide or magnesium hydroxide acts to form slag.

The content of aluminum hydroxide and/or magnesium hydroxide in the gas generating composition is preferably 0.1 to 20% by mass, more preferably 1 to 15% by mass. When the content of aluminum hydroxide and/or magnesium hydroxide is in the above-described range, the formed amount of toxic nitrogen oxides and carbon monoxide can be reduced as the combustion temperature is lowered, and when the gas generating composition is used in an inflator for an air bag, a burning rate necessary for expanding and developing an air bag in a predetermined time can also be assured.

The gas generating composition of the present invention can be in a four-component system consisting of (a) glass powder, (b) aluminum hydroxide and/or magnesium hydroxide, (c) an organic compound as fuel, and (d) an oxygen-containing oxidizing agent.

The organic compound as fuel of the component (c) is at least one selected from tetrazole compounds, guanidine compounds, triazine compounds and nitroamine compounds.

The tetrazole compounds include 5-aminotetrazole, bitetrazole ammonium, etc. The guanidine compounds include guanidine nitrate, mono-, di- or tri-aminoguanidine nitrate, nitroguanidine, etc. The triazine compounds include melamine, cyanuric acid, ammeline, ammelide, ammelande, etc.

The oxygen-containing oxidizing agent as component (d) is at least one selected from nitrate, perchlorate, chloric acid, a basic metal nitrate and ammonium nitrate.

The nitrate includes alkali metal nitrates such as potassium nitrate and sodium nitrate and alkaline earth metal nitrates such as strontium nitrate. The perchlorates include potassium perchlorate, sodium perchlorate, magnesium perchlorate, ammonium perchlorate, etc. The basic metal nitrate includes a basic copper nitrate etc.

When the gas generating composition of the present invention is in a four-component system consisting of the components (a) to (d), the content of component (a) is preferably 0.1 to 20% by mass, more preferably 1 to 10% by mass, the content of component (b) is preferably 0.1 to 20% by mass, more preferably 1 to 15% by mass, the content of component (c) is preferably 30 to 60% by mass, more preferably 35 to 50% by mass, and the content of component (d) is preferably 30 to 60% by mass, more preferably 40 to 55% by mass.

A preferable example of the gas generating composition in a four-component system is a composition comprising (a) glass powder, (b) aluminum hydroxide and/or magnesium hydroxide, (c) guanidine nitrate and (d) a basic copper nitrate. In this case, the content of (a) glass powder is preferably 2 to 6% by mass, the content of (b) aluminum hydroxide and/or magnesium hydroxide is preferably 1 to 10% by mass, the content of (c) guanidine nitrate is preferably 30 to 60% by mass, and the content of (d) a basic copper nitrate is preferably 30 to 60% by mass.

Another preferable example of the gas generating composition in a four-component system is a composition comprising (a) glass powder, (b) aluminum hydroxide and/or magnesium hydroxide, (c) nitroguanidine and (d) a basic copper nitrate. In this case, the content of (a) glass powder is preferably 1 to 5% by mass, the content of (b) aluminum hydroxide and/or magnesium hydroxide is preferably 1 to 15% by mass, the content of (c) nitroguanidine is preferably 25 to 60% by mass, and the content of (d) a basic copper nitrate is preferably 30 to 60% by mass.

When the gas generating composition of the present invention is in a system containing the components (a) and (b) but not a binder, in a four-component system containing the components (a) to (d), or in a six-component system containing the components (a) to (d) and the component (f) of the additive and the component (g) of silicon dioxide, its molded article may, if poor in molding strength, collapse upon actual combustion and burn too acceleratedly to make control of combustion. Accordingly, the binder as component (e) is preferably added.

The binder as component (e) is at least one selected from carboxymethyl cellulose (CMC), sodium carboxymethylcellulose (CMCNa), potassium carboxymethylcellulose, carboxymethylcellulose ammonium, cellulose acetate, cellulose acetate butyrate (CAB), methyl cellulose (MC), ethyl cellulose (EC), hydroxyethyl cellulose (HEC), ethylhydroxyethyl cellulose (EHEC), hydroxypropyl cellulose (HPC), carboxymethylethyl cellulose (CMEC), fine crystalline cellulose, polyacrylamide, an aminated product of polyacrylamide, polyacryl hydrazide, a copolymer of acrylamide and a metal acrylate, a copolymer of polyacrylamide and polyacrylic ester, polyvinyl alcohol, acrylic rubber, guar gum, starch and silicone. Among these, sodium carboxymethylcellulose (CMCNa) and guar gum are preferable in view of stickiness cost and ignitability of the binder.

The binder (e) is preferably contained in the gas generating composition in an amount of 1.0 to 5.0 mass %, more preferably 1.5 to 3.5 mass %, when it is combined with the component (b), not to lose a processability or moldability and make the combustion gas clear.

When the gas generating composition of the present invention is in a system containing the components (a) and (b), but not an additive, in a four-component system containing the components (a) to (d), or in a six-component system containing the components (a) to (d) and the component (e) of the binder and the component (g) of silicon dioxide, the additive as component (f) is added preferably for the purpose of assisting the actions of the components (a) and (b).

The additive as component (f) is at least one selected from metal oxides such as copper oxide, iron oxide, zinc oxide, cobalt oxide, manganese oxide, molybdenum oxide, nickel oxide, bismuth oxide, gallium oxide, silica and alumina, metal carbonates or basic metal carbonates such as cobalt carbonate, calcium carbonate, magnesium carbonate, a basic zinc carbonate and a basic copper carbonate, composite compounds of metal oxides or hydroxides such as Japanese acid clay, kaolin, talc, bentonite, diatomaceous earth and hydrotalcite, metal acid salts such as sodium silicate, mica molybdate, cobalt molybdate and ammonium molybdate, molybdenum disulfide, calcium stearate, silicon nitride and silicon carbide. These additives can reduce the burning temperature of the gas generating agent, regulate the burning rate and reduce the amount of toxic nitrogen oxides and carbon monoxide formed after combustion.

When the gas generating composition of the present invention is in a four-component system containing the components (a) to (d) or in a six-component system containing the components (a) to (d) and the component (e) of the binder and the component (f) of the additive, silicon dioxide as component (g) is preferably added for the purpose of improvement of ignition of the component (c). The ignition is greatly improved in particular with use of a guanidine compound for the component (c).

Silicon dioxide of the component (g) has a specific surface area of 100 to 500 $m^2/g$, preferably 150 to 300 $m^2/g$. The specific surface area is determined according to BET method.

When the gas generating composition of the present invention is in a five- or seven-component system consisting of the components (a) to (f), the content of component (a) is preferably 0.1 to 20% by mass, more preferably 1 to 10% by mass, the content of component (b) is preferably 0.1 to 20% by mass, more preferably 1 to 15% by mass, the content of component (c) is preferably 5 to 60% by mass, more preferably 10 to 55% by mass, the content of component (d) is preferably 10 to 85% by mass, more preferably 20 to 75% by mass, the content of component (e) is preferably 20% by mass or less, the content of the component (f) is preferably 20% by mass or less and the content of the component (g) is preferably 5% by mass or less.

A preferable example of the gas generating composition in a five-component system is a composition comprising (a) glass powder, (b) aluminum hydroxide and/or magnesium hydroxide, (c) nitroguanidine, (d) strontium nitrate and (e) sodium carboxymethylcellulose or guar gum.

Another preferable example of the gas generating composition in a five-component system is a composition comprising (a) glass powder, (b) aluminum hydroxide and/or magnesium hydroxide, (c) nitroguanidine, (d) a basic copper nitrate and (e) guar gum.

A still another preferable example of the gas generating composition in a five-component system is a composition comprising (a) glass powder, (b) aluminum hydroxide and/or magnesium hydroxide, (c) melamine, (d) a basic copper nitrate and (e) sodium carboxymethylcellulose or guar gum.

A still another preferable example of the gas generating composition in a five-component system is a composition comprising (a) glass powder, (b) aluminum hydroxide and/or magnesium hydroxide, (c) guanidine nitrate, (d) a basic copper nitrate and (e) sodium carboxymethylcellulose or guar gum.

A preferable example of the gas generating composition in not less than five-component system is a composition comprising (a) glass powder, (b) aluminum hydroxide and/or magnesium hydroxide, (c) a mixed fuel of two or three components selected from guanidine nitrate, nitroguanidine and melamine, (d) a basic copper nitrate and (e) sodium carboxymethylcellulose or guar gum.

A different, preferable embodiment is that including silicon dioxide of the component (g) in addition to the gas generating composition comprising the above shown (a) to (e).

The gas generating composition of the present invention can be molded in a desired shape, and formed into a molded article in the shape of a single-perforated cylinder, a perforated (porous) cylinder or pellets. These molded articles can be produced by a method in which the gas generating composition is mixed with water or an organic solvent and the mixture is extrusion-molded (molded articles in the shape of a single-perforated cylinder and a perforated (porous) cylinder) or by a compression-molding method using a pelletizer (molded article in the shape of pellets).

The gas generating composition of the present invention or the molded article obtained therefrom can be used in, for example, an inflator for an airbag of a driver side, and inflator for an air bag of a passenger side, an inflator for a air bag for a side collision, and inflator for an inflatable curtain, an inflator for a knee bolster, an inflator for an inflatable seat belt, an inflator for a tubular system and a gas generator for pretensioner in various vehicles.

Further, the inflator using the gas generating composition of the present invention or the molded article obtained therefrom may be a pyrotechnic type in which a gas is supplied only from a gas generating agent or a hybrid type in which a gas is supplied from both of a compressed gas such as argon and a gas generating agent.

Moreover, the gas generating composition of the present invention or the molded article obtained therefrom can also be used as an igniting agent called an enhancer (or a booster) for transferring energy of a detonator or a squib to a gas generating agent.

EXAMPLES

The present invention is illustrated more specifically by referring to the following Examples, but the present invention is not limited thereto.

Examples 1 to 6 and Comparative Example 1

Gas generating compositions each having a formulation shown in Table 1 were produced, and each of the gas generating compositions was molded into 2 g of a strand. This strand was installed in a closed bomb having an inner capacity of 1 liter, and the inside of the bomb was purged with nitrogen. Further, the bomb was pressurized up to 6,860 kPa with nitrogen, and the strand was ignited by electrifying a nichrome wire and completely burned. After combustion, combustion residues were collected from the bomb and observed for their state with the naked eye.

In Table 1, GN is guanidine nitrate, BCN is a basic copper nitrate, CMCNa is sodium carboxymethylcellulose, and #1723 and #7056 are glass powders having the following compositions.

#1723 (Aluminosilicate glass; softening point of 908° C.) (% by mass): $SiO_2$ (57)/$Al_2O_3$ (16)/$B_2O_3$ (4)/MgO (7)/CaO (10)/BaO (6) (softening point of 908° C.)

#7056 (Borosilicate glass; softening point of 718° C.) (% by mass): $SiO_2$ (68)/$Al_2O_3$ (3) /$B_2O_3$ (18)/$LiO_2$ (1)/$Na_2O$ (1) /$K_2O$ (9) (softening point of 718° C.)

#C-490P (phosphate glass; softening point of about 400° C.) (% by mass): $P_2O_5$(54-56)/$Al_2O_3$ (9-11)/$Na_2O$ (19-21)/$K_2O$ (14-16)

#C-700P (phosphate glass; softening point of about 640° C.) (% by mass): $P_2O_5$(50.5)/$Al_2O_3$ (14.5)/$Na_2O$ (20)/$K_2O$ (15)

TABLE 1

| | Formulation (formulation ratio:mass %) |
|---|---|
| Example 1 | #1723/$Al(OH)_3$/GN/BCN/CMCNa = 3/5/38.0/49.0/5 |
| Example 2 | #1723/$Al(OH)_3$/GN/BCN/CMCNa = 5/5/37.0/48.0/5 |
| Example 3 | #7056/$Al(OH)_3$/GN/BCN/CMCNa = 3/5/38.0/49.0/5 |
| Example 4 | #7056/$Al(OH)_3$/GN/BCN/CMCNa = 5/5/37.0/48.0/5 |
| Example 5 | #C-490P/$Al(OH)_3$/GN/BCN/CMCNa = 2.0/9.8/41.9/43.8/2.5 |
| Example 6 | #C-700P/$Al(OH)_3$/GN/BCN/CMCNa = 4.8/9.5/40.8/42.5/2.4 |
| Comparative Example 1 | $Al(OH)_3$/GN/BCN/CMCNa = 5/39.6/50.4/5 |

In Examples 1 to 6, the strands after combustion maintained the shape thereof before combustion, but in Comparative Example 1, the strand was finely smashed.

The invention claimed is:

1. A gas generating composition, comprising:

(a) 0.5 to 5% by mass of phosphate glass comprising $P_2O_5$, $Al_2O_3$, $Na_2O$ and $K_2O$, and having a softening point of 550° C. or less;

(b) 1 to 15% by mass of aluminum hydroxide;

(c) an organic compound as fuel, said fuel is at least one selected from the group consisting of tetrazole compounds, guanidine compounds, triazine compounds, and nitroamine compounds;

(d) an oxygen-containing oxidizing agent; and (e) a binder being at least one selected from the group consisting of carboxymethyl cellulose, sodium carboxymethylcellulose, potassium carboxymethylcellulose, carboxymethylcellulose ammonium, cellulose acetate, cellulose acetate butyrate, methyl cellulose, ethyl cellulose, hydroxyethyl cellulose, ethylhydroxyethyl cellulose, hydroxypropyl cellulose, carboxymethylethyl cellulose, fine crystalline cellulose, polyacrylamide, an aminated product of polyacrylamide, polyacryl hydrazide, a copolymer of an acrylamide and a metal acrylate, a copolymer of polyacrylamide and a polyacrylic ester, polyvinyl alcohol, acrylic rubber, guar gum, starch, and silicone.

2. The gas generating composition as claimed in claim 1, further comprising:

at least one selected from the group consisting of, (f) an additive selected from a metal oxide and a metal carbonate, and (g) silicon dioxide having a specific surface area of 100 to 500 $m^2/g$.

3. The gas generating composition as claimed in claim 2, wherein the content of the component (c) is 30 to 60% by mass, the content of the component (d) is 60% by mass or less, the content of the component (e) is 10% by mass or less, the content of the component (f) is 10% by mass or less, and the content of the component (g) is 5% by mass or less.

4. The gas generating composition as claimed in claim 1, wherein the oxygen-containing oxidizing agent as component (d) is at least one selected from the group consisting of nitrates, perchlorates, chloric acid, a basic metal nitrate, and ammonium nitrate.

5. A gas generating composition comprising:

(a) 0.5 to 5% by mass of phosphate glass comprising $P_2O_5$, $Al_2O_3$, $Na_2O$ and $K_2O$, and having a softening point of 550° C. or less;

(b) 1 to 15% by mass of aluminum hydroxide;

(c) an organic compound as fuel, said fuel is at least one selected from the group consisting of tetrazole compounds, guanidine compounds, triazine compounds, and nitroamine compounds;

(d) an oxygen-containing oxidizing agent;

at least one selected from the group consisting of the following components (e) and (f), (e) a binder, (f) an additive selected from a metal oxide and a metal carbonate; and optionally (g) silicon dioxide having a specific surface area of 100 to 500 $m_2/g$, wherein the binder as component (e) is at least one selected from the group consisting of carboxymethyl cellulose, sodium carboxymethylcellulose, potassium carboxymethylcellulose, carboxymethylcellulose ammonium, cellulose acetate, cellulose acetate butyrate, methyl cellulose, ethyl cellulose, hydroxyethyl cellulose, ethylhydroxyethyl cellulose, hydroxypropyl cellulose, carboxymethylethyl cellulose, fine crystalline cellulose, polyacrylamide, an aminated product of polyacrylamide, polyacryl hydrazide, a copolymer of an acrylamide and a metal acrylate, a copolymer of polyacrylamide and a polyacrylic ester, polyvinyl alcohol, acrylic rubber, guar gum, starch, and silicone.

6. The gas generating composition as claimed in claim 2, wherein the additive as component (f) is at least one selected from the group consisting of metal oxides including cupric oxide, iron oxide, zinc oxide, cobalt oxide, manganese oxide, molybdenum oxide, nickel oxide, bismuth oxide, gallium oxide, silica or alumina, metal hydroxides including cobalt hydroxide or iron hydroxide, metal carbonates or basic metal carbonates including cobalt carbonate, calcium carbonate, magnesium carbonate, a basic zinc carbonate or a basic copper carbonate, composite compounds of metal cixides or metal hydroxides including Japanese acid clay, kaolin, talc, bentonite, diatomaceous earth or hydrotalcite, metal acid salts including sodium silicate, mica molybdate, cobalt molybdate or ammonium molybdate, silicone, molybdenum disulfide, calcium stearate, silicon nitride, and silicon carbide.

7. The gas generating composition as claimed in claim 2, wherein the component (e) the binder is contained in an amount of 1.0 to 5.0 mass %.

8. A gas generating composition, comprising:

0.5 to 1% by mass of phosphate glass comprising $P_2O_5$, $Al_2O_3$, $Na_2O$ and $K_2O$ and having a softening point of 550° C. or less;

1 to 15% by mass of aluminum hydroxide;

guanidine nitrate;

a basic copper nitrate; and a binder being at least one selected from the group consisting of carboxymethyl cellulose, sodium carboxymethylcellulose, potassium carboxymethylcellulose, carboxymethylcellulose ammonium, cellulose acetate, cellulose acetate butyrate, methyl cellulose, ethyl cellulose, hydroxyethyl cellulose, ethylhydroxyethyl cellulose, hydroxypropyl cellulose, carboxymethylethyl cellulose, fine crystalline cellulose, polyacrylamide, an aminated product of polyacrylamide, polyacryl hydrazide, a copolymer of an acrylamide and a metal acrylate, a copolymer of polyacrylamide and a polyacrylic ester, polyvinyl alcohol, acrylic rubber, guar gum, starch, and silicone.

9. The gas generating composition as claimed in claim 8, further comprising:

magnesium hydroxide.

10. A molded article of the gas generating composition being in the shape of a single perforated cylinder or a perforated cylinder, obtained by extrusion-molding the gas generating composition as defined in claim 1 or 8.

11. An inflator for air bag, using the gas generating composition as defined in claim 1 or 8.

12. An inflator for air bag, using the molded article of the gas generating composition as defined in claim 10.

13. The gas generating composition as claimed in claim 1, wherein a particle diameter of the phosphate glass, in terms of 50% particle diameter, is 10 to 300 μm.

14. The gas generating composition as claimed in claim 13, wherein the particle diameter of the phosphate glass is 10 to 100 μm.

15. The gas generating composition as claimed in claim 14, wherein a particle diameter of the phosphate glass is 10 to 50 μm.

16. A gas generating composition, comprising:

an organic compound as a fuel, said fuel is at least one selected from the group consisting of tetrazole compounds, guanidine compounds, triazine compounds, and nitroamine compounds;

0.5 to 5% by mass of phosphate glass comprising $P_2O_5$, $Al_2O_3$, $Na_2O$ and $K_2O$, and having a softening point of 550° C. or less;

1 to 15% by mass of aluminum hydroxide; and at least one selected from the group consisting of, a binder, an additive selected from a metal oxide and a metal carbonate, and silicon dioxide having a specific surface area of 100 to 500 $m_{2/}g$, wherein the binder is at least one selected from the group consisting of carboxymethyl cellulose, sodium carboxymethylcellulose,potassium carboxymethylcellulose, carboxymethylcellulose ammonium, cellulose acetate, cellulose acetate butyrate, methyl cellulose, ethyl cellulose, hydroxyethyl cellulose, ethylhydroxyethyl cellulose, hydroxypropyl cellulose, carboxymethylethyl cellulose, fine crystalline cellulose, polyacrylamide, an aminated product of polyacrylamide, polyacryl hydrazide, a copolymer of an acrylamide and a metal acrylate, a copolymer of polyacrylamide and a polyacrylic ester, polyvinyl alcohol, acrylic rubber, guar gum, starch, and silicone.

* * * * *